United States Patent [19]

Sanders et al.

[11] 3,954,058

[45] May 4, 1976

[54] COAL MINE SHOOTING PLUG

[76] Inventors: Barney Sanders, Box 24; Wetzel R. Sanders, Box 32, both of Midkiff, W. Va. 25540

[22] Filed: May 3, 1974

[21] Appl. No.: 466,857

[52] U.S. Cl. ..... 102/30
[51] Int. Cl.[2] ..... F42B 3/20
[58] Field of Search ..... 102/30, 26

[56] References Cited

UNITED STATES PATENTS

| | | | |
|---|---|---|---|
| 971,264 | 9/1910 | Goodrow et al. | 102/30 |
| 2,296,504 | 9/1942 | Crater | 102/30 |
| 2,388,232 | 10/1945 | Tappan | 102/30 |
| 3,264,992 | 8/1966 | Beck | 102/30 |

FOREIGN PATENTS OR APPLICATIONS

| | | | |
|---|---|---|---|
| 812,888 | 5/1959 | United Kingdom | 102/30 |

*Primary Examiner*—Verlin R. Pendegrass
*Attorney, Agent, or Firm*—Clarence A. O'Brien; Harvey B. Jacobson

[57] ABSTRACT

A recoverable plug for the blasting hole of a mine. A steel ball is enclosed within one hollowed-out portion of the plug, and sealed therein, so that the plug may be magnetically recovered after the blasting has been completed; or later, when the mined material is treated with a fluid such as water. The hollowed-out portion is further charged with compressed air, or similar fluid, to assist in absorbing the shock when the blast occurs, with the hollowed-out-portion also making the plug bouyant when it passes through a washing or similar liquid. Suitable expansion means is provided to "seat" the plug in a blasting hole.

8 Claims, 6 Drawing Figures

COAL MINE SHOOTING PLUG

FIELD OF THE INVENTION AND SUMMARY OF THE PRIOR ART

Known forms of blasting, bore-hole loading, and tamping plugs are evidenced by the following U.S. Pat. Nos., all of which disclose various means for expanding the plug within a drilled hole. Reichert (158,126, issued Dec. 22, 1874) and Swingle (993,907, issued May 30, 1911) each illustrating threaded means for expanding the plug; Heitzman (2,007,568, issued July 9, 1935) and Crater (2,296,504, issued Sept. 22, 1942) each show wedge-type expanding means; and the Kihlström patent (3,208,381, issued Sept. 28, 1965) discloses a conically-shaped insert forced into place by successive packaged explosives.

SUMMARY OF THE INVENTION

Among the objects and advantages of our invention are the following:

1. To provide a magnetically-attracted insert for the plug so that it may be recovered by magnetically "searching" the blasted area, or, magnetically recovered when the mined material is washed or similarly fluid-treated.

2. To provide sealing means to seal the perimeter of the plug in the blast hole.

3. To provide a steel ball within a sealed chamber within the plug, and pressurize the interior of the chamber.

4. To provide a concussion cup at the end of the plug facing the charge to assist in preventing the blast from escaping past the plug and out the drilled hole.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
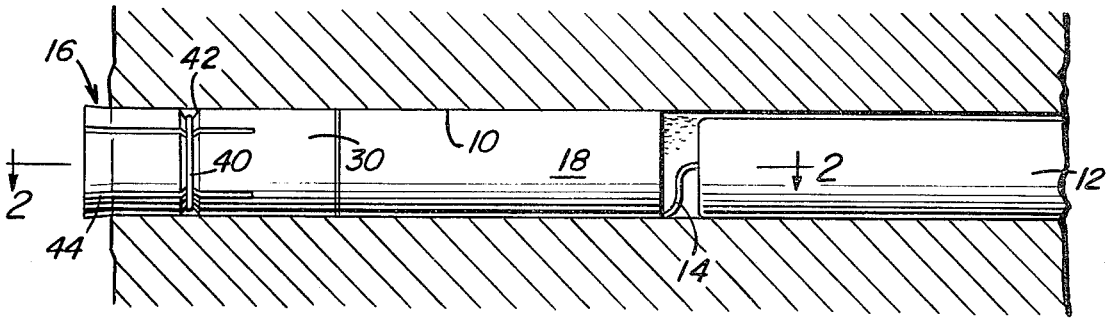
FIG. 1 is a partly sectional view of a charge and plug inserted in a drilled hole.
Figure 2:
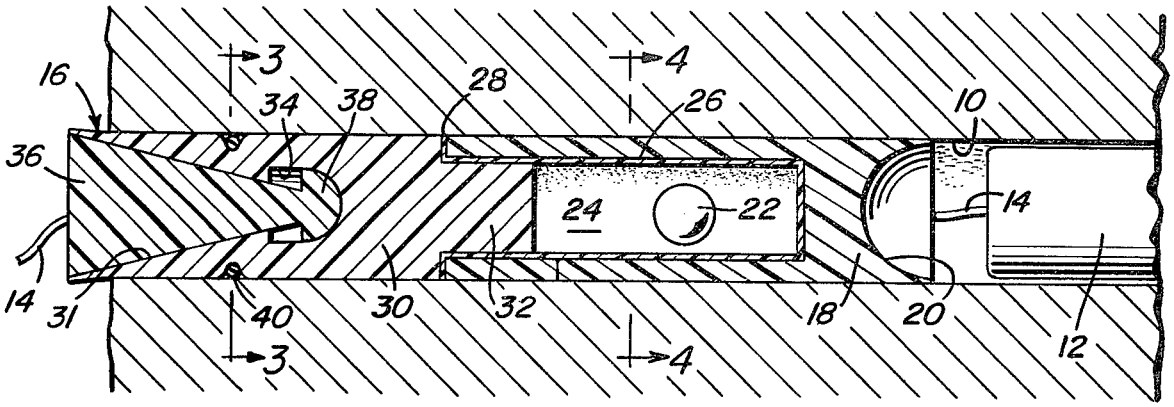
FIG. 2 is a similarly sectional view taken generally along line 2—2 in FIG. 1 showing various parts of the plug in cross-section.
Figure 3:
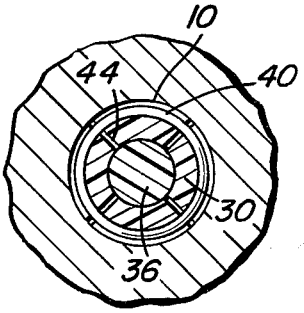
FIG. 3 is a cross-sectional view taken approximately along the line 3—3 of FIG. 2.
Figure 4:
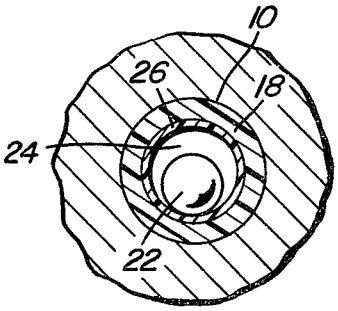
FIG. 4 is a cross-sectional view taken approximately along the line 4—4 of FIG. 2.

The drilled hole for the charge 12, the fuse 14, and the plug 16 is indicated by reference numeral 10 with the plug being generally the same size as the dynamite 12 and closely fitting the hole 10. In FIG. 2, the three major parts of the plug are denoted as the forward plug portion 18, the central portion 30, and the rearmost portion 36. The forward portion 18 includes a generally hemispherical concussion cup 20, hollow chamber 24 covered with a self-sealing rubber composition 26, similar to that used in automotive tires, and an entrapped steel ball 22 in chamber 24.

Central portion 30 has a reduced end nose 32 telescoped into and adhesively secured to forward portion

18 as at 28. Conically-shaped expanding or wedging means 36, having an enlarged, generally hemispherically-shaped tip 38 is mated into the conical open end bore 31 of central portion 30 which has slits 44—44 wherein which roughly divide the rearward portion of central portion 30 into four segments. The inner end of the bore 31 includes an enlarged, hemispherically-shaped recess 34 which receives and retains the wedge 36 in assembled relation to the central portion 30 with the length of the recess 34 being greater than tip 38 to enable the wedge 36 to be driven inwardly to its innermost position as illustrated in FIG. 2. A rubber band 40, or similar elastic means, is seated in a groove 42 which surrounds 30, passes through the slits 44; and, as viewed in FIG. 2 is between the portions 36 and 38 of the expanding means.

Figure 5:
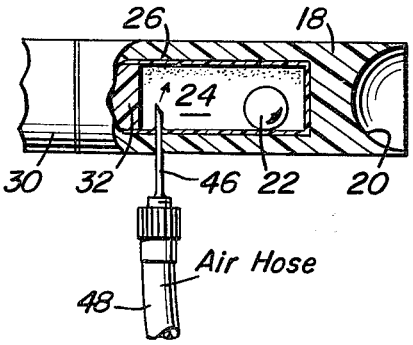
FIG. 5 is a partial view showing the chamber enclosing the steel ball being filled with air.
Figure 6:
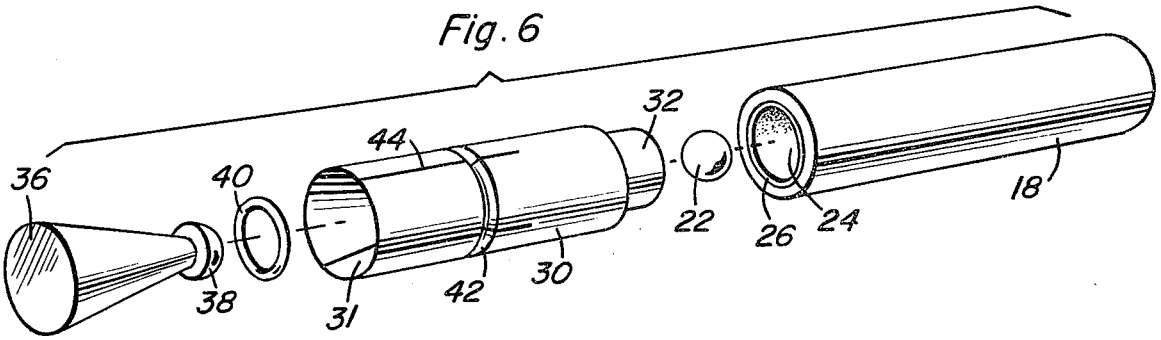
FIG. 6 is an exploded perspective view of the plug.

As viewed in FIG. 5, with the chamber 24 coated with self-sealing rubber (similar to that used in vehicular tires), and the parts 18 and 30 adhesively secured together, air hose 48, with the needle 46 is inserted into the chamber 24, and chamber 24 is filled with air well above atmospheric pressure. The needle is then withdrawn and the plug 16 is inserted into the hole 10 and wedge 36 driven inwardly.

All of the materials used in the plug are resilient and will be inherently fireproof, or treated to become fireproof, before final assembly. After the explosive charge has been inserted in the drilled hole, the plug inserted and seated, the fuse is ready for ignition. The force of the explosion will cause longitudinal compression of the plug and radial expansion of the relatively thin resilient wall of chamber 24, thus effectively sealing the hole 10 so that the explosion force and gases will be retained in the hole until the blast dislodges the surrounding material.

After the explosion occurs, the entire plug is usually recovered intact. Recovery of the plug may be obtained by passing a magnet adjacent the broken coal and/or minerals. Other magnetic means may be associated with the conveying means or tipple for the blasted materials, or, magnetic means may be associated with washing, or other fluid treatment, to recover the plug. The recovery feature alone is estimated to save over one-third of the blasting and plugging costs in a given coal mine.

In addition to the recovery features, the interrelationships of the concussion cup 20, pressurized and expandible chamber 24, and expanding means 36–38, combine to provide a more effective blast, in which more loose coal is recovered for a given size explosive charge, and less gaseous material escapes around the plug than in the more conventional devices.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multi-part plug including one part having a chamber with a steel ball sealed therewithin, a middle part secured to said first part and receiving a third part to seat the plug in a drilled hole, said chambered part also having a concussion cup facing an explosive charge, the middle part having a nose on one end, sealed to said chambered part, said third part including wedge means fitting into slit portions of said middle part to fix the plug within a drilled hole.

2. The plug of claim 1 wherein the sealed chamber is further coated interiorly with a self-sealing rubber and then pressurized above atmospheric pressure.

3. The plug of claim 2 wherein said middle part is quartered by said slit portions, said wedge means including a conically-shaped expanding part having a hemispherical tip inserted between said slit portions, a rubber band in a groove circumscribing said middle and third parts.

4. A recoverable blasting plug for use in a blasting hole to form a closure therefor outwardly of a blasting charge, said plug comprising an elongated body of non-metallic, expandable material, one end of the body having a generally hollow semi-spherical concussion cup end disposed in facing relation to the blasting charge, the other end of said body including means expandable into engagement with the blast hole, said body including a sealed chamber intermediate the ends thereof defined by a thin, resilient peripheral wall for radial expansion into sealing engagement with the blast hole when the blasting charge is detonated and the concussion end and adjacent portions of the body are forced longitudinally toward the chamber.

5. The structure as defined in claim 4 wherein said chamber includes a ferrous member therein to enable recovery of the plug by magnetic means, said body of non-metallic material completely surrounding said ferrous member to prevent contact between the ferrous member and the wall of the blasting hole.

6. The structure as defined in claim 4 wherein said chamber includes a lining of self-sealing material on the inner surface thereof to enable pressurizing the chamber by inserting an inflating needle through the body into the chamber.

7. The structure as defined in claim 4 wherein said expandable means includes a conical recess in the end of the body, a conical wedge received in said recess, said body having a plurality of longitudinal slits in the periphery of the recess to enable radial expansion when the wedge is driven into the recess, resilient means encircling the exterior of the end of the body having the slits therein to bias the end of the body radially inwardly, said wedge having an enlargement on the inner end retained in an enlarged cavity at the inner end of the recess, said enlargement being longitudinally movable in the cavity to enable expansion of the portions of the body between the slits.

8. The structure as defined in claim 7 wherein said chamber includes a ferrous member therein to enable recovery of the plug by magnetic means, said body of non-metallic material completely surrounding said ferrous member to prevent contact between the ferrous member and the wall of the blasting hole, said chamber including a lining of self-sealing material on the inner surface thereof to enable presurizing the chamber by inserting an inflating needle through the body into the chamber.

* * * * *